United States Patent [19]

Grise et al.

[11] 4,003,495

[45] Jan. 18, 1977

[54] CAN COVER OPENABLE BY A SPOON OR THE LIKE

[75] Inventors: Frederick Gerard Joseph Grise, Osterville; Walter Carl Lovell, Wilbraham, both of Mass.

[73] Assignee: USM Corporation, Boston, Mass.

[22] Filed: Apr. 26, 1976

[21] Appl. No.: 680,578

[52] U.S. Cl. ..... 220/268; 220/277

[51] Int. Cl.[2] ..... B65D 41/32

[58] Field of Search ..... 220/265–269, 220/276, 277; 222/541; 113/121 C, 15 A

[56] References Cited

UNITED STATES PATENTS

| | | | |
|---|---|---|---|
| 2,176,898 | 10/1939 | Fried | 220/268 |
| 3,362,569 | 1/1968 | Geiger | 220/268 |
| 3,902,626 | 9/1975 | Jordan et al. | 220/268 |

*Primary Examiner*—George T. Hall
*Attorney, Agent, or Firm*—Carl E. Johnson; Richard B. Megley; Vincent A. White

[57] ABSTRACT

A sheet metal can end or cover comprises a largely or wholly removable panel bounded by a peripheral tear line, and an integral closure within the panel, the closure being defined by a generally arcuate groove or depression formed at one side thereof with a coterminous, rupturable weakening line having a mid-locality extending nearer to but spaced from the panel tear line to provide a lifting lip therefor and a deflectable tongue portion extending toward the center of the panel. The weakening line and the tear line are preferably of the fractured but integral type fully disclosed in our U.S. Pat. No. 3,881,630 and extend on opposite sides of the panel. On depressing the locality of the mentioned weakening line with a tool, such as the tip of a spoon, the closure opens then permitting the tip to bear upwardly on the inside of the lifting lip as the bowl of the spoon is pivoted upon the tongue portion. Consequently the panel tear line is progressively ruptured and the panel may be readily tilted upwardly or fully removed by bearing downwardly on the tool handle.

12 Claims, 7 Drawing Figures instance, such fractured section in tougher steel sheet preferably extends along the line 18 roughly about a fourth of an inch on both sides of the above mentioned median X—X. It should also be observed that the fracture along the weakening line 24 also preferably extends about a half inch which is usually adequate for initial rupture. Note too that the fracture in the line 24 extends along the outer side of the can end but is protected by extending in the groove 26 as well as subsequent lacquering, whereas the fracture of the tear line 18 extends along the inner side of the can end and may likewise be given a lacquering.

For opening the end 12 of the can 10, which is generally intended for non-pressurized liquid or pourable contents (which may be vacuum packed) as distinguished from carbonated beverages, for instance, a tool preferably in the form of a lever such as a spoon S (FIGS. 3–7 incl.) may be conveniently used as next explained. Bearing angularly downward with the tip of the spoon, as shown in FIGS. 4 and 5, against the locality where the median X—X intersects or substantially coincides with the weakening line 24, the tongue-shaped closure 28 is depressed inwardly of the panel about an inner end of the closure, i.e. a region in the plane of the panel approximately between opposed ends, or points whereat the groove 26 is of minimum depth. A rib 34 (FIGS. 1, 3) desirably is formed across this region to provide an intially stationary fulcrum against which the spoon can pivotally bear. As soon as rupture of the line 24 commences, as indicated in FIG. 6, the spoon tip is urged beneath the exposed undersurface of the lip 30, and the underside of the bowl B of the spoon S is pivoted against the cross rib 34 (FIGS. 6, 7) by bearing downwardly on the spoon handle. The bottom of the spoon bowl B may have a sliding fulcrum relation on the outside of the closure including the rib 34, as progressive rupture in the weakening line 24 on both sides of the median allows the spoon tip to get a better purchase on the lip 30. When next, as shown in FIG. 7, the spoon handle is pressed toward the can top to further pivot the spoon clockwise, the weakening line 24 ceases rupture and the tear line 18 is disrupted beginning in the vicinity of its intersection by the median X—X due to further upward pressure exerted by the spoon tip lifting the lip 30. Accordingly the panel 16 may be increasingly opened and tilted upwardly with respect to the outer rim of the can body. An advantage of providing the cross rib 34 is that it enables panel rupture and opening to be attained with more consistent force.

It will be appreciated from the foregoing that the entire panel 16 may be removed in the manner indicated if the tear line 18 extends in a closed path, or only a portion of the panel may be relatively lifted if it is desired to pour solids larger than would pass through the opened closure 28 or to quickly empty the can of granular or liquid contents. Any tool other than a spoon S, preferably one having a pointed or tapering closure-engaging end, may of course be utilized for opening the can. In applying the tool, it successively ruptures the line 24 by applying pressure to its externally fractured section, preferably initially at the locality of deepest coining, thus depressing the tongue-like closure 28, next prying upwardly on the lip 30 to rupture the tear line 18 progressively from the median X—X. It will be noted that the narrowest width or radial span of the panel being along the median adjacent to the rupture of the lip portion enables the panel to resist depression such as the closure 28 initially incurs, and that thereafter the upward prying imposes tension and bending across the tear line 18 until breaking thereat is easily effected through the leverage of the tool exerted under the radially inner end of the lip. Untidy separate disposal of the closure 18 and/or the panel 16 from the can 10 is discouraged by the end structure described in the interest of avoiding littering.

Having thus described our invention, what we claim as new and desire to secure by Letters Patent of the United States is:

1. A sheet metal can end comprising a relatively liftable panel defined by a tear line, the panel including and encompassing a tongue-like closure portion openable by relative depression, the closure portion being defined at least in part by an arcuate weakening line characterized by at least a mid-portion thereof being fractured but integral with the panel, said mid-portion being spaced inwardly from said tear line by a lip substantially coplanar with the panel and the lip tapering narrower adjacent said mid-portion of the weakening line than at other portions thereof.

2. A can end as in claim 1 wherein said tear line extends along a periphery substantially encircling said panel and is of the fractured but integral type, being externally shear-coined to provide the fracture adjacent to the inner side of the can top and uniformly spaced from its rim.

3. A can end as in claim 1 wherein the weakening line is disposed along an inner side of a symmetrical groove or depression formed in the periphery of the external side of the closure, the locality of minimum residuum of the fracture extending in the closure groove not more than about one-fourth inch to either side of a median through the closure whereby initial rupture of the weakening line in the vicinity of the median due to opening pressure of a tool bearing inwardly on the closure facilitates application of upward opening leverage on the panel by the tip of the tool acting on the underside of the lip portion extending between the tear line and the weakening line.

4. A can end as in claim 3 wherein said lip portion is narrowest between the localities where said median intersects the weakening line and the tear line.

5. A can end as in claim 1 wherein a rib is formed transversely in said tongue-like closure portion to provide an initially stationary fulcrum against which a tool may pivot to bear upwardly on the underside of said lip and disrupt said tear line.

6. A can end as in claim 1 wherein the tear line is formed in a wall of a radially outer peripheral groove which is deeper than an inner groove a wall of which is formed with said weakening line.

7. A sheet metal can top of the easy-open type having a pair of arcuate spaced weakening lines an outer one of which is of larger radius of curvature and length and spaced nearer to the can top periphery, the second or inner line defining a fractured, depressible tongue-like integral closure generally substantially coplanar with said one line and extending in the wall of a groove depressed in the can top from a locality inwardly from said one line to a locality spaced from, but more adjacent to, said one line.

8. A can top as in claim 7 wherein a rib extends across the closure substantially between inner ends of said groove.

9. A can top as in claim 7 wherein each of the weakening lines is of the fractured but integral type, the

CAN COVER OPENABLE BY A SPOON OR THE LIKE

CROSS REFERENCE TO RELATED APPLICATION

Copending application Ser. No. 574,643 for U.S. Letters Patent filed in our names on May 5, 1975, relates to a method for making a weakening line in sheet metal. An application Ser. No. 677,798 also filed in our names, on Apr. 16, 1976 relates to mechanism for making can covers with easy-open closures in a punch press.

BACKGROUND OF THE INVENTION

This invention pertains to can ends or covers having easy opening means. Can covers of sheet metal have hitherto been provided with depressible closures defined by weakening lines as disclosed, for instance, in our U.S. Pat. No. 3,881,630, or in U.S. Pat. No. 3,929,251 or 3,931,909. Moreover, the broad idea of providing a can end having a rupturable closure liftable by a tool is not new as shown in the U.S. Pat. No. 2,119,533 or 2,312,359, and in the Swedish Pat. No. 22,359 to Lunde et al. Can ends provided with panels defined by peripheral weakening lines and having attached tabs for lifting such panels, as in U.S. Pat. No. 3,220,599 or 3,820,681 are also known.

SUMMARY OF THE INVENTION

Despite fairly crowded prior art there still exists a genuine need for, and it is an object of this invention to provide, a relatively simple can end having an easily tiltable and/or fully removable panel.

A further object of the invention is to provide a can end which is economical to make in large nestable quantities, is convenient to use, and is of a shape and structure not apt to trap foreign matter.

For these purposes our improved easy-open can end has a relatively large rupturable panel readily liftable from a can by a pivotable tool first used to rupture a relatively small closure integral with the panel. As herein shown no pull tab is required for opening, and the closure may remain attached to the panel which, in turn, may remain attached to the container after opening. Briefly, the invention in one aspect comprises a can end having a rupturable tongue-like closure which may, for instance, be semi-circular. within a rupturable panel, the panel and the closure each being defined by a weakening line formed, respectively, on opposite sides of the can end, and the closure being sufficiently relatively depressible by a tool such as a spoon to enable an end of the spoon to bear upwardly on the panel adjacent to its weakening line to disrupt it and then enable further disrupting of the last mentioned line upon pressing down on the opposite end of the spoon to rock its intermediate bowl portion on the closure.

The invention is of particular advantage in opening cans adapted for containing flowable material, not necessarily liquid, or which may be in part liquid and part solids. It will be appreciated that in some instances, particularly when only limited small amounts of the contents are at first desired to be poured, the closure tongue may be disrupted very little, and that when thereafter the entire contents are to be withdrawn the panel may be quickly lifted by using the initial closure rupture for entry of a lifting lever having any of a wide variety of shapes not limited to those of spoons.

BRIEF DESCRIPTION OF THE DRAWINGS

The foregoing and other features of the invention will now be more particularly described in connection with a preferred embodiment and with reference to the accompanying drawings thereof, in which.

DESCRIPTION OF PREFERRED EMBODIMENT

Figure 1:
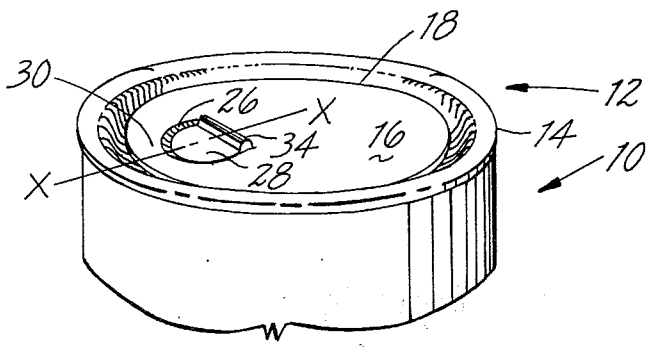
FIG. 1 is a perspective view of the upper end of a can provided with a generally planar rupturable panel, and a tongue-like closure therein having a weakening line a mid-locality of which is adjacent to but spaced from a tear line defining the panel.
Figure 2:
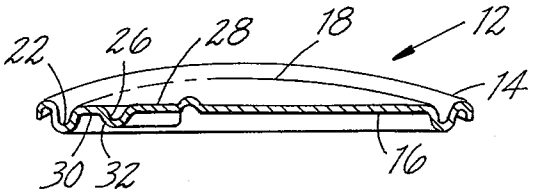
FIG. 2 is a sectional view of the can end only, shown in FIG. 1, and taken along a median of the closure.
Figure 3:
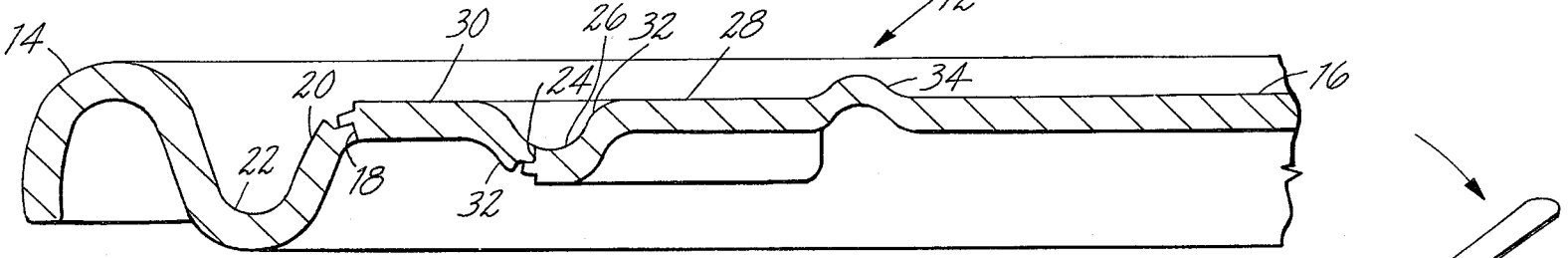
FIG. 3 is a much enlarged detail of the can cover portion shown in the dashed circle in FIG. 2.
Figure 4:
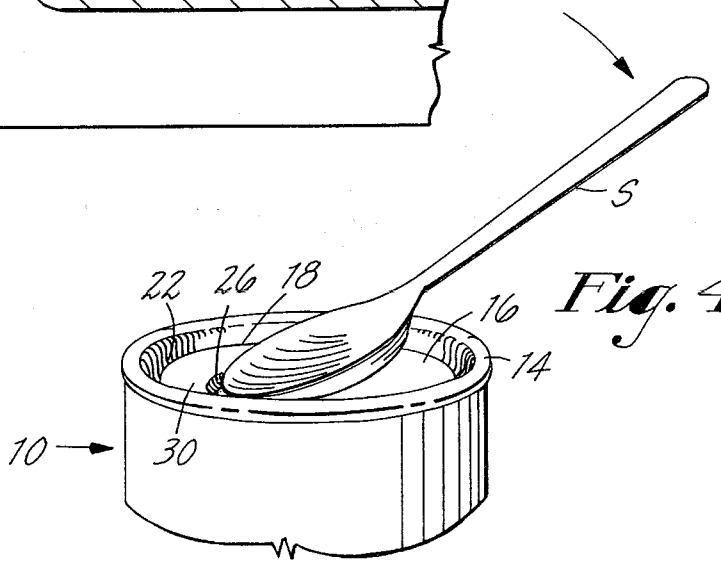
FIG. 4 is a view similar to FIG. 1 but showing a lever in the form of a spoon being initially applied for opening the can.
Figure 5:
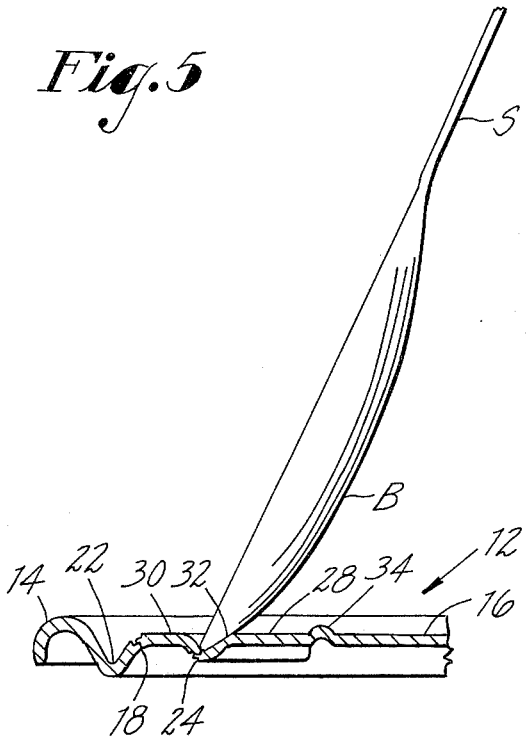
FIG. 5 is a section corresponding to FIG. 3 and with the spoon applied as in FIG. 4 to initially rupture the closure weakening line.
Figure 6:
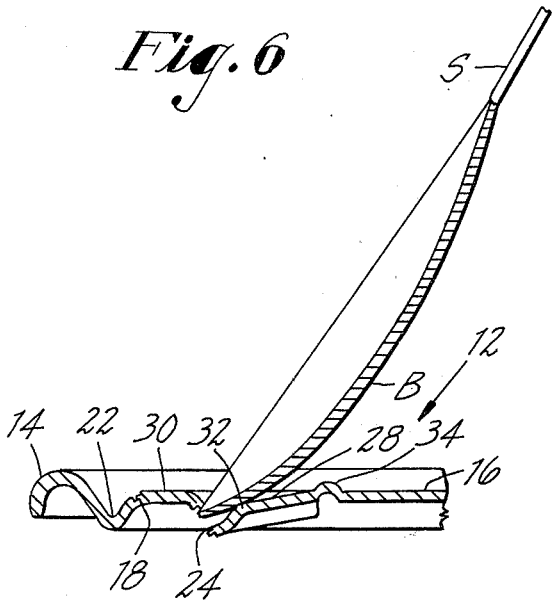
FIG. 6 is a section corresponding to FIG. 5 but at the next stage wherein the tip of the spoon has ruptured the closure and is prying upwardly on a lip of the panel as the bowl of the spoon finds a slidable fulcrum on the closure tongue.
Figure 7:
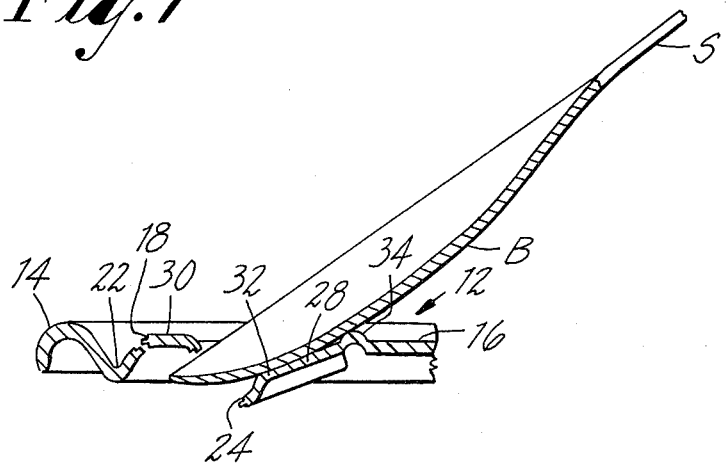
FIG. 7 is a section similar to FIGS. 5 and 6 showing the panel ruptured and being relatively lifted.

Referring first to FIGS. 1–3, a typical can body of sheet metal 10 (FIG. 1) is provided with a separately formed can end generally designated 12. The can end 12, commonly thought not necessarily circular, in this instance includes an outer rim or skirt 14 and an inner circular panel 16 defined by a peripheral tear line 18. As clearly shown in FIG. 3, the line 18 (magnified for purposes of illustration) is preferably formed by shear-coining and swaging on an outer convex surface constituting one wall 20 of an outer groove 22 in the can end 12. The panel 16 is for the most part planar and may be at a slightly lower level than the ridge of the rim 14.

Within the panel 16 an arcuate weakening line 24 (FIG. 3) (in this instance semi-circular, by way of example) is formed coterminously in a wall of an inner groove or depression 26 defining, at least in part, a depressible, generally tongue-shaped closure 28. The groove 26 is usually of substantially uniform depth for ease of manufacture (though the depth can diminish inwardly), and extends from a more central region of the panel 16 outwardly toward a liftable lip portion 30 of the panel disposed between the weakening line 24 and the tear line 18. The lip 30 preferably is radially narrowest where a median X—X (FIG. 1) of the tongue-shaped closure would radially extend and progressively widens on opposite sides of the median. Again, formation of the weakening line 24 is desirably, but not necessarily, by longitudinally shear-coining and swaging a transversely convex surface 32 of the wall of the groove 26 as taught for instance in U.S. Pat. No. 3,881,437. It will be noted from that commonly owned patent, the technique of which is hereby incorporated by reference, that the weakening line is desirably characterized by a section which is fractured but integral with the can end 12.

While, for reasons hereinafter noted, a fractured section of the tear line 18 may not be necessary when the cover is of sufficiently thin aluminum sheet, for outer line having been shear-coined on the outer side of the can top, and the inner line having been shear-coined on the inside of the can top.

10. A can top as in claim 9 wherein the outer weakening line is at least as long as a semi-circle spaced about one-eighth inch from a circular can top rim, and the inner line in its fractured locality closest to the outer line extends about one-half inch.

11. An easy-open can end comprising sheet metal bounded by an outer skirt and having a generally planar panel peripherally spaced from said skirt by an outer groove, said panel being largely defined by a tear line created by a peripheral coining in the external side of a transversely convex surface of the outer groove, and a depressible tongue-like closure extending integrally in the panel, the closure being spaced from said tear line by an inner, arcuate, substantially semi-circular groove of lesser depth than said outer groove, said inner groove having a generally uniform depth, a wall defining said inner groove having its inner surface longitudinally indented by shear-coining to render the closure rupturable and depressible in response to localized external pressure applied thereon whereby access for rendering the tear line disruptable and the panel relatively liftable in response to internally applied stress is attained.

12. A can end as in claim 11 wherein a cross rib is formed externally on said closure substantially between the ends of said semi-circular groove to serve as a fulcrum for a can opening tool.

* * * * *

UNITED STATES PATENT OFFICE

CERTIFICATE OF CORRECTION

Patent No. 4,003,495 Dated January 18, 1977

Inventor(s) Frederick G. J. Grise et al.

It is certified that error appears in the above-identified patent and that said Letters Patent are hereby corrected as shown below:

On the Title Page, delete Item [73].

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*